US006423179B1

(12) United States Patent
Jardeby et al.

(10) Patent No.: US 6,423,179 B1
(45) Date of Patent: Jul. 23, 2002

(54) METHOD FOR INCREASING THE WET STRENGTH OF A TISSUE MATERIAL

(75) Inventors: Joakim Jardeby; Anna Nihlstrand, both of Göteborg; Thami Chihani, Mölnlycke; Susan Sandberg, Onsala, all of (SE)

(73) Assignee: SCA Hygiene Products AB, Gothenberg (SE)

( * ) Notice: Subject to any disclaimer, the term of this patent is extended or adjusted under 35 U.S.C. 154(b) by 0 days.

(21) Appl. No.: 09/877,084

(22) Filed: Jun. 11, 2001

Related U.S. Application Data

(63) Continuation of application No. PCT/SE99/02307, filed on Dec. 9, 1999, now abandoned.

(30) Foreign Application Priority Data

Dec. 11, 1998 (SE) ..... 9804294-8

(51) Int. Cl.[7] ..... D21H 25/04

(52) U.S. Cl. ..... 162/111; 162/164.3; 162/164.6; 162/192

(58) Field of Search ..... 162/111, 164.3, 162/164.6, 136, 192

(56) References Cited

U.S. PATENT DOCUMENTS 5,698,688 A 12/1997 Smith et al.

FOREIGN PATENT DOCUMENTS

WO 96/27044 9/1996
WO 97/36-52 10/1997

*Primary Examiner*—Peter Chin
(74) *Attorney, Agent, or Firm*—Burns, Doane, Swecker & Mathis, L.L.P.

(57) ABSTRACT

A method increases the wet strength of a tissue material, and a tissue material (2') which has been subjected to the method. The wet strength agent included in the tissue material (2, 2') has an intrinsic, normal wet strength-increasing effect which can be achieved by a curing course having chemical reactions and/or physical interactions between different reactive sites of the wet strength agent, between different reactive sites of the cellulose fibres, and reaction and/or interaction between the reactive sites of the wet strength agent and of the cellulose fibres, resulting in a network of polymers which is kept together by bonds. The method includes formation of radicals and/or excited conditions with high reactivity in gas phase at atmospheric pressure, wherein the radicals and/or excited conditions increase the number of the reactions and/or interactions and/or the number of the reactive sites and thereby also the number of bonds, so that the strength of the network is increased and the tissue material (2') is conferred an increased wet strength. The method can be implemented for all tissue paper materials which include cellulose fibres and a suitable wet strength agent.

13 Claims, 1 Drawing Sheet

METHOD FOR INCREASING THE WET STRENGTH OF A TISSUE MATERIAL

This application is a continuation of International Application Ser. No. PCT/SE99/02307, filed on Dec. 9, 1999, which International Application was published by the International Bureau in English on Jun. 22, 2000 and now abandoned.

Method for increasing the wet strength of a tissue material.

TECHNICAL FIELD

The present invention relates to a method for increasing the wet strength of a tissue material. The invention further relates to a tissue material which has been subjected to the method according to the invention.

The invention pertains to the field of wet-strong tissue materials which at least comprise cellulose fibres and a wet strength agent, which for example can be a PAE-resin (Poly Amide-Epichlorohydrine) or another suitable wet strength agent.

Furthermore, the invention touches upon the field of methods for radical formation in gas phase at atmospheric pressure, such as corona treatment, plasma treatment, electronic beam treatment, or treatment with UV light.

The invention can be implemented for all tissue materials which comprise cellulose fibres and a suitable wet strength agent.

BACKGROUND OF THE INVENTION

The expressions "tissue" and "tissue material" are commonly used for designating both creped and through-air dried tissue paper. Roughly, tissue materials can be divided into non wet-strong and wet-strong tissue grades. Non wet-strong tissue is utilised, for example, in toilet paper and so-called facial tissue, whereas wet-strong tissue is utilised, for example, in kitchen roll paper, paper towels, napkins, and in industrial wiping materials.

Currently, when manufacturing wet-strong tissue grades, predominantly cationic wet strength resins are used in order the obtain the desired wet strength, which usually is expressed as wet tensile strength, or as a ratio between wet tensile strength and dry tensile strength (relative wet strength).

One commonly occurring type of wet strength agent for wet-strong tissue grades are so-called polyamide-epichlorohydrine resins (PAE-resins). PAE-resins and most other current wet strength agents contain some kind of reactive groups, such as unsaturated sites (double or triple bonds), epoxy-, amino-, hydroxy- or carboxylic groups. In certain conditions, these reactive groups can be caused to react or interact with chemical groups of other wet strength agent molecules, or with chemical groups of cellulose fibres included in a tissue material. This reaction is usually called curing, and results in a crosslinking and network formation which give the tissue material a higher wet strength. Normally, the curing process takes 3–5 weeks and, in certain conditions, this long outing time can give detrimental substances in the tissue material, for example originating from the pulp raw material, a possibility to disturb or prevent the curing process, so that the intrinsic, normal wet strength-increasing effect of the wet strength agent never is reached.

Normally, the curing course proceeds faster at a raised temperature, and it is previously known that a heat treatment provides a tissue material with full wet strength in a shorter time than the 3–5 weeks which are required with storage at room temperature. A forced curing at a raised temperature is often utilised for quality control of tissue, implying that tissue specimens for wet strength evaluation are "quick-cured" in an oven, normally at 105° C. for 10 minutes. The wet strength level which is obtained by means of a forced curing generally corresponds relatively well to the wet strength level obtained by means of normal cuing at room temperature during one month. In some cases, however, the forced curing has proved to result in higher values than those which can be obtained by means of normal curing at room temperature or at a temperature which is lower than room temperature (for example in a cold warehouse). Therefore, it has been suggested previously that a heat treatment should be utilised in order to obtain a forced curing also in commercial tissue paper production.

Another type of materials, which have found use for example as industrial wiping materials, are so-called spunlace materials which are manufactured by means of needling with high-pressure water jets. This type of fibre fabrics are also called hydroentangled nonwoven materials and usually also comprise other, longer fibres than pulp fibres. The cohesive force in hydroentangled nonwoven materials is primarily friction between the fibres included in the material and, in case cellulose fibres are present, also hydrogen bonds. One problem which may occur with certain types of hydroentangled nonwoven materials is that the fibre-fibre friction, and thereby also the wet strength, is reduced strongly when such a material is wetted in an aqueous liquid.

Accordingly, in WO 96/27044 it is suggested that a hydroentangled nonwoven material should be subjected to plasma or corona treatment with the purpose of increasing the wet strength. According to WO 96/27044, the disclosed treatment provides an increased fibre-fibre friction also in a wet state, something which results in a higher wet strength of the hydroentangled nonwoven material after the treatment.

It is previously known that methods for radical formation in gas phase, such as the above-mentioned plasma or corona treatment, UV light, electronic beam technique, and other methods can be utilised in order to initiate chemical reactions. The underlying mechanisms do not require any heat supply, but create reactive sites by means of forming radicals and/or excited conditions which in themselves are very reactive.

Something which can be perceived as a disadvantage with conventional wet strength agents for tissue materials is the relatively long storage time which is required in order to achieve the full wet strength-increasing effect.

Heat treatment with the purpose of shortening the storage time by means of a faster curing process has proven to be costly and difficult to accomplish in practice.

Furthermore, in certain applications where tissue materials are utilised, it can be desirable with a higher wet strength than which is possible to reach with natural curing.

SUMMARY OF THE INVENTION

Accordingly, the first object of the present invention is to provide a method which confers an increased wet strength to a tissue material without any heat treatment being necessary, and which enables a higher wet strength level than with normal curing and minimises the need for a special storage time for curing.

This first object is achieved by means of a method in accordance with claim 1, wherein the wet strength agent included in the tissue material has an intrinsic, normal wet strength-increasing effect which can be achieved by means of a curing course. Thereby, the curing course comprises chemical reactions and/or physical interactions between different reactive sites of the wet strength agent, between different reactive sites of the cellulose fibres, and reaction and/or interaction between the reactive sites of the wet strength agent and the reactive sites of the cellulose fibres, wherein said reactions and/or interactions result in a network of polymers which is kept together by bonds. According to the invention, the method comprises formation of radicals and/or excited conditions with high reactivity in gas phase at atmospheric pressure, wherein the radicals and/or the excited conditions increase the number of said reactions and/or interactions and/or the number of reactive sites and thereby also the number of bonds, so that the strength of the network is increased and the tissue material thereby is conferred an increased wet strength.

A second object of the present invention is to provide a tissue material, which after having been subjected to the method exhibits an increased wet strength.

In accordance with claim 12, this second object of the invention is achieved by means of the tissue material comprising cellulose fibres and a wet strength agent, which has an intrinsic, normal wet strength-increasing effect which can be achieved by means of a curing course comprising chemical reactions and/or physical interactions between different reactive sites of the wet strength agent, between different reactive sites of the cellulose fibres, and reaction and/or interaction between the reactive sites of the wet strength agent and the reactive sites of the cellulose fibres. Thereby, the reactions and/or interactions result in a network of polymers which is kept together by bonds. According to the invention, the tissue material exhibits an increased wet strength after having been exposed to radicals and/or excited conditions with high reactivity in gas phase at atmospheric pressure, wherein the radicals and/or the excited conditions have increased the number of said reactions and/or interactions and/or the number of reactive sites and thereby also the number of bonds, so that the strength of the network has been increased.

"Normal wet strength-increasing effect", as used herein should be understood as the wet strength increase which the tissue material has obtained owing to the wet strength agent at the point in time in question by means of normal curing at room temperature or at a lower temperature than room temperature.

BRIEF DESCRIPTION OF THE DRAWINGS

In th following, the invention will be described with reference to the attached FIG. 1, which schematically shows a side view of a corona treatment unit 1 for practising a preferred embodiment of the method according to the invention.

EXAMPLE 1

Figure 1:
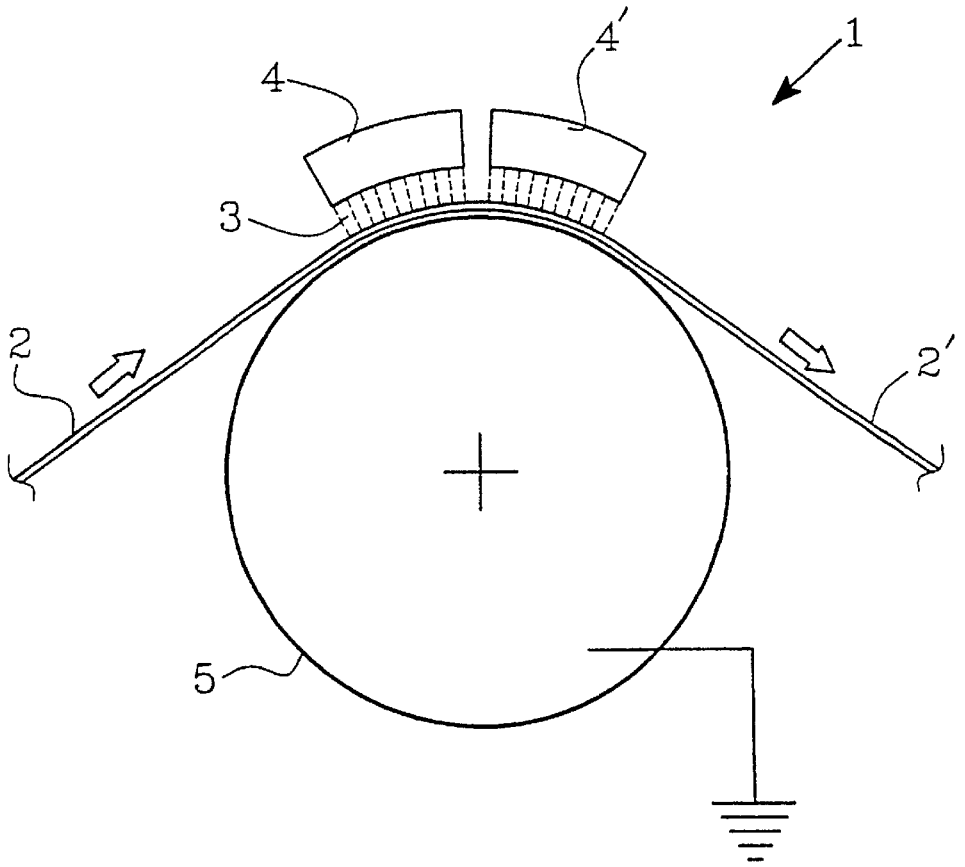

In this laboratory trial, a commercial, wet-strong tissue material A having a 30 g/m$^2$ grammage and a 25% creping degree was utilised. The tissue material comprised 65 weight-% peroxide bleached softwood pulp and 35 weight-% peroxide bleached softwood-CTMP, and also an addition of approx. 0.6 weight-% (dry) PAE wet strength agent of a commercially available type which is marketed under the brand name Kenores™.

After its manufacture, the tissue material A had been stored at room temperature for about 6 months, which is the reason why the curing process most probably should have been completed and the included wet strength agent should have reached its intrinsic, normal wet strength-increasing effect.

The tissue material A 2, 2' was corona-treated on one of its sides with different energy doses in a pilot-scale corona treatment apparatus 1, of the type which schematically is shown in FIG. 1. Thereby, the electrode gap 3, i.e. the distance between the electrodes 4, 4' and the earthed roll 5, was 2.5 mm. The web width of the tissue material 2, 2' was 0.3 m, whereas the effective electrode length was 0.42 m.

The results from the trials are evident from Table 1 below, wherein wet strength and wet tensile index refers to the fact that the specimens were wetted with distilled water immediately before the tensile testing.

TABLE 1

Corona treatment of tissue material A

| Energy dose | Current | Web speed | Wet tensile strength (N/m) | | | Wet tens. index (Nm/g) |
|---|---|---|---|---|---|---|
| (kWs/m$^2$) | (Å) | (m/min) | MD | CD | √MD × CD | √MD × CD |
| 0 | 0 | 0 | 91 +– 0% | 55 +– 0% | 71 +– 0% | 2.3 +– 0% |
| 0.90 | 0.85 | 30 | 105 + 15% | 58 + 5% | 78 + 9.9% | 2.6 + 13.0% |
| 2.7 | 0.85 | 10 | 108 + 19% | 56 + 2% | 78 + 9.9% | 2.6 + 13.0% |
| 2.9 | 2.8 | 30 | 116 + 27% | 55 +– 0% | 80 + 12.7% | 2.7 + 17.4% |
| 8.8 | 2.8 | 10 | 122 + 34% | 58 + 5% | 84 + 18.3% | 2.8 + 21.7% |

As is evident from the results reported in Table 1 from the laboratory trials, the corona treatment gave the tissue material an increased wet strength at all energy doses which were used.

EXAMPLE 2

In a second trial series, a tissue material N was manufactured by means of a commercial tissue paper machine, wherein the grammage was 25.6 g/m$^2$ and the creping degree 25 %. The tissue material N comprised 65 weight-% peroxide bleached softwood sulphate pulp and 35 weight-% peroxide bleached softwood CTMP. Approximately 0.5 weight-% (dry) PAE-resin (Kenores 1445) was added as a wet strength agent. Directly after the tissue paper production, specimens of the tissue material were extracted for corona treatment, and for use as untreated reference material. After either no or 4 weeks storage/curing time, a batch of the tissue material N was treated in the above-mentioned corona treatment unit 1 in the following conditions: web speed 10 m/min, effective electrode length 0.42 m, current 2.8 A and energy dose 8.8 kWs/m$^2$. In this trial series, the electrode gap 3 was 2.0 mm. The corona treatment was performed only on one side of the tissue material 2, 2'. Furthermore, both specimens in the form of a roll and in the form of cut sheets, which were attached with scotch tape onto a fibre web of spunlace material as a supporting carrier material for the tissue sheets through the corona treatment unit 1, were treated. After the corona treatment, specimens of the tissue material N were extracted in a conventional way and, after conditioning in a climate room at 23° C., 50% r.h. for 4 h, were tested for dry tensile strength and wet tensile strength in water in a conventional tensile tester at a tensioning rate of 60 mm/min. The results from this trial series are evident from Table 2.

TABLE 2

| Storage-curing/ treatment | Corona treatment of tissue material N: Tensile strength, dry (N/m) MD | CD | Tensile strength, wet (N/m) MD | CD | √MD × CD | Relative wet strength (%) RWS |
|---|---|---|---|---|---|---|
| 0 weeks/ untreated | 259.6 | 190.1 | 30.6 +– 0% | 21.2 +– 0% | 25.5 +– 0% | 11.5 +– 0% |
| 0 weeks + corona (roll) | 259.9 | 149.2 | 34.2 + 11.8% | 20.9 – 1.4% | 26.7 + 4.7% | 13.6 + 18.3% |
| 0 weeks + corona (sheet) | 258.8 | 193.7 | 36 + 17.6% | 21.1 – 0.5% | 27.6 + 8.2% | 12.3 + 7.0% |
| 4 weeks/ untreated | 332.2 | 220.2 | 70.8 +– 0% | 44.9 +– 0% | 56.4 +– 0% | 20.8 +– 0% |
| 4 weeks + corona (roll) | 326.8 | 214.2 | 77.5 + 9.5% | 42.6 – 5.1% | 57.5 + 2.0% | 21.7 + 4.3% |
| 4 weeks + corona (sheet) | 316.8 | 225.1 | 79.6 + 12.4% | 44.1 – 1.8% | 59.2 + 5.0% | 22.2 + 6.7 |

As is evident from the results reported in Table 2, also in this trial series the corona treatment gave an increase of both wet tensile strength and relative wet strength RWS in water.

As used herein, relative wet strength RWS refers to relative strength in water calculated according to the formula RWS=(√ wet tensile strength MD×CD/√ dry tensile strength MD×CD)×100%.

EXAMPLE 3

In a third trial series, a tissue material V was produced by means of a pilot tissue machine, wherein the grammage was 28.0 g/m$^2$ and the creping degree 25%. The tissue material V comprised 50 weight-% peroxide bleached softwood sulphate pulp and 50 weight-% peroxide bleached high temperature-CTM of softwood. Approximately 0.7 weight-% (dry) PAE-resin (Kenores 1440) was added as a wet strength agent. Thereafter, specimens were corona-treated in the same way as in example 2. The results from this trial series are evident from Table 3 below.

TABLE 3

| Storage-curing/ treatment | Corona treatment of tissue material V: Tensile strength, dry (N/m) MD | CD | Tensile strength, wet (N/m) MD | CD | √MD × CD |
|---|---|---|---|---|---|
| 4 weeks/ untreated | 246 | 251 | 58 + –0% | 49 + –0% | 53.3 + –0% |
| 4 weeks + corona | 366 | 266 | 83 + 43% | 50 + 2% | 64.4 + 21% |

As is evident from the results reported in Table 3, in this trial series the corona treatment primarily gave an increase of wet tensile strength MD.

EXAMPLE 4

In a fourth trial series, laboratory sheets were produced by means of a dynamic sheet former of a commercially available type, wherein the grammage was 30 g/m$^2$. The laboratory sheets were formed from 100% peroxide bleached softwood sulphate pulp. In this trial series, both laboratory sheets without (TCF) and with (TCF+PAE) approximately 1.0 weight-% (dry) PAE-resin (Kenores 1440) were formed. The laboratory sheets were allowed to dry naturally in standard climate 23° C., 50% rh for 12 h. The after, a number of the laboratory sheets without wet strength agent (TCF+CORONA), and a number of the laboratory sheets with wet strength agent (TCF+PAE+CORONA), were corona treated in the same way as in Example 2, except that the electrode gap now was 1.85 mm. Thereafter, specimens for tensile testing were punched out and conditioned at 23° C., 50% rh for 4 h. The results form th fourth trial series are evident from Table 4 below.

TABLE 4

| Laboratory sheet/ code | Corona treatment of naturally dried laboratory sheets: Tensile strength, wet MD (N/m) | N/m increase vs. TCF | % increase vs. TCF |
|---|---|---|---|
| TCF | 7 ± 1 | — | — |
| TCF + PAE | 99 ± 7 | 92 | 1314% |
| TCF + CORONA | 13 ± 9 | 6 | 86% |
| TCF + PAE + CORONA (according to the invention) | 341 ± 44 | 334 | 4771% |

As is evident from the results reported in Table 1, the corona treated laboratory sheets with wet strength agent obtained a much higher initial wet tensile strength an what could be expected from the initial wet tensile strengths of non-corona treated laboratory sheets with wet strength resin (TCF+PAE) and from corona-treated laboratory sheets without any wet strength agent (TCF+CORONA). It should be noted that the results in Table 4 thus refer to initial wet strengths before the laboratory sheets have been subject to any drying at an elevated temperature.

Accordingly, when the initial wet strength is concerned, the combination of wet strength agent addition and corona treatment according to the invention provides a very large synergistic effect which has not been disclosed previously.

This synergistic effect is valuable, since it makes it possible to achieve a higher initial wet strength level before possible detrimental substances in a tissue material are able to disturb the normal, relatively slow, curing course of the wet strength agent.

DETAILED DESCRIPTION OF PREFERRED EMBODIMENTS

In the following, the invention will be described in greater detail, and when applicable with reference to the attached FIG. 1.

In a preferred embodiment of the method according to the invention, the tissue material 2 comprises cellulose fibres and a wet strength agent, which has an intrinsic, normal wet strength-increasing effect which can be achieved by means of a curing course comprising chemical reactions and/or physical interactions between different reactive sites of the wet strength agent, between different reactive sites of the cellulose fibres, and reaction and/or interaction between the reactive sites of the wet strength agent and the reactive sites of the cellulose fibres. The chemical reactions and/or the interactions result in a network of polymers which is kept together by bonds.

According to the invention and the preferred embodiment, the method comprises formation of radicals and/or excited conditions with high reactivity in gas phase at atmospheric pressure. Due to the fact that the radicals and/or the excited conditions increase the number of said reactions and/or interactions and/or the number of reactive sites and thereby also the number of said bonds, the strength of the network is increased, whereby the tissue material 2' is conferred an increase wet strength.

In the preferred embodiment of the method according to the invention, besides the normal wet strength-increasing effect of the wet strength agent, the tissue material 2 exhibits an intrinsic, normal potential for wet strength increase when exposed to said radicals and/or excited conditions. According to this embodiment, the increase of the wet strength of the tissue becomes larger than the normal wet strength-increasing effect and the normal potential for wet strength increase together when the tissue material 2' is subjected to the method.

In a particularly advantageous embodiment, the increase of the wet strength of the tissue material becomes more than two times larger than the normal wet strength-increasing effect and the normal potential for wet strength increase together, when the tissue material 2' is subjected to the method. In this embodiment, the tissue material preferably is subjected to the method before the normal curing course has been completed.

In one advantageous embodiment, by means of the method, the wet strength of the tissue material 2', expressed as wet tensile strength MD, is increased with more than about 15% in comparison with the normal wet strength-increasing effect.

In another advantageous embodiment of the method according to the invention, by means of the method, the wet strength of the tissue material 2', expressed as √ wet tensile strength MD×CD, is increased further with more than about 9% in comparison with the normal wet strength-increasing effect. This embodiment of the method is illustrated by the trial series in EXAMPLE 1. However, it is also conceivable with less advantageous embodiments of the method according to the invention where the wet strength increase is smaller.

According to another embodiment of the method according to the invention, by means of the method, the wet strength of the tissue material 2', expressed as relative wet strength RWS, is increased fiber with more than about 7% in comparison with the normal wet strength-increasing effect. This embodiment of the method, illustrated by the trial series in EXAMPLE 2, can be convenient to implement in those cases where a high dry strength is undesired but a relatively high wet strength still is required, for example in applications where it is more important to retain the softness of the tissue material than to achieve maximum wet strength.

In preferred embodiments of the invention, the method comprises that the tissue material 2, 2' is subjected to methods for radical formation in gas phase at atmospheric pressure selected from the group corona treatment, plasma treatment, electronic beam treatment, or treatment with UV light. However, it is also conceivable with embodiments of the method which utilise other treatment methods generating a similar effect.

In one advantageous embodiment of the invention, the method is performed during or immediately after drying the tissue material 2 in a drying device of a paper machine. In this way, a higher wet strength level than normal of the tissue material is enabled directly after the paper machine, and no storage in order to obtain curing of the wet strength agent is necessary.

In another advantageous embodiment, the method is performed during or immediately after creping the tissue material 2.

In another embodiment of the invention, the method is performed in a separate post treatment line. This offers more freedom of choice when the design of the necessary equipment, for instance, for corona treatment is concerned, and also a greater possibility to control the intensity of the post-treatment, for example by means of regulating the web speed of the tissue material.

In still another embodiment of the invention, the method is performed in a separate converting line for articles of the tissue material 2, and/or with a converted article of the tissue material 2. This embodiment provides advantages, such as no need for an additional separate post-treatment line and that the web speed can be adapted more easily than when the treatment is performed in the tissue paper machine.

According to a preferred embodiment of the tissue material according to the invention, the material comprises cellulose fibres and a wet strength agent. Thereby, the wet strength agent has an intrinsic, normal wet strength-increasing effect which can be achieved by means of a curing course comprising chemical reactions and/or physical interactions between different reactive sites of the wet strength resin, between different reactive sites of the cellulose fibres, and reaction and/or interaction between the reactive sites of the wet strength agent and the reactive sites of the cellulose fibres, wherein the reactions and/or interactions result in a network of polymers which is kept together by bonds. According to the invention and the preferred embodiment, the tissue material 2' exhibits an increased wet strength after having been exposed to radicals and/or excited conditions with high reactivity in gas phase at atmospheric pressure, wherein the radicals and/or the excited conditions have increased the number of reactions and/or interactions and/or the number of reactive sites, and thereby also the number of said bonds, so that the strength of the network has been increased.

In the preferred embodiment according to the invention, besides the normal wet strength-increasing effect of the wet strength agent, the tissue material 2' has exhibited an intrinsic normal potential for wet strength increase when exposed to the radicals and/or the excited conditions, wherein the exposure has given the tissue material a wet strength increase which is larger than the normal wet strength-increasing effect and the normal potential for wet strength increase together.

In a particularly advantageous embodiment of the tissue material 2', the wet strength increase is more than two times higher than the normal wet strength-increasing effect and the normal potential for wet strength increase together. In this embodiment, the tissue material preferably has been subjected to the method before the normal curing course has been completed.

In one advantageous embodiment of the invention, the tissue material 2' has a wet tensile index √MD×CD which is higher than about 2.5 Nm/g. A tissue material according to this embodiment is particularly well suited for applications with unusually high demands for wet strength. However, it is also conceivable with less advantageous embodiments of the tissue material where the wet tensile index √MD×CD is lower than 2.5 Nm/g.

In advantageous embodiments of the invention, the tissue material 2' has been treated with one or several methods for radical formation in gas phase at atmospheric pressure selected from the group of corona treatment, plasma treatment, electronic beam treatment or treatment with UV light. However, it is also conceivable with embodiments of the invention in which the tissue material has been treated by means of another suitable method generating a similar effect.

According to one advantageous embodiment of the invention, the tissue material 2' comprises 0.5–2.0 weight-% (dry) PAE-resin as a wet strength agent.

The present invention should not be regarded as being limited to what has been described herein in connection with the preferred embodiments, or to what is shown in the attached figure, but the scope of the invention is defined by the attached claims.

What is claimed is:

1. A method for increasing the wet strength of a tissue material having cellulose fibres and wet strength agent, the method comprises curing the tissue material by subjecting the tissue material to a method selected from the group of corona treatment, plasma treatment, electronic beam treatment, or treatment with UV light.

2. A method according to claim 1, wherein, by means of the method, the wet strength of the tissue material, expressed as wet tensile strength MD, is increased more than about 15% in comparison with the normal wet strength-increasing effect.

3. A method according to claim 1, wherein, by means of the method, the wet strength of the tissue material, expressed as √ wet tensile strength MD×CD, is increased more than about 9% in comparison with the normal wet strength-increasing effect.

4. A method according to claim 1, wherein, by means of the method, the wet strength of the tissue material, expressed as relative wet strength, is increased more than about 7% in comparison with the normal wet strength-increasing effect.

5. A method according to claim 1, wherein the method is performed during or immediately after drying the tissue material in a drying device of a paper machine.

6. A method according to claim 1, wherein the method is performed during or immediately after creping the tissue material.

7. A method according to claim 1, wherein the method is performed in a separate post-treatment line.

8. A method according to claim 1, wherein the method is performed in a separate converting line for articles of said tissue material and with a converted article of the tissue material.

9. A tissue material comprising cellulose fibres and wet strength agent, said tissue material having been subjected to the method according to claim 1.

10. A tissue material according to claim 9, the tissue material having a wet tensile index √MD×CD which is higher than about 2.5 Nm/g.

11. A tissue material according to claim 9, wherein the tissue material comprises 0.5–2.0 weight-% (dry) PAE-resin as a wet strength agent.

12. A method according to claim 1, wherein the method is performed in a separate converting line for articles of said tissue material.

13. A method according to claim 1, wherein the method is performed with a converted article of the tissue material.

* * * * *